US006269885B1

(12) United States Patent
Barber et al.

(10) Patent No.: US 6,269,885 B1
(45) Date of Patent: Aug. 7, 2001

(54) BLADE HEIGHT CONTROL SYSTEM FOR A MOTORIZED GRADER

(75) Inventors: Dennis R. Barber, Oconomowoc; Patrick T Mullins, Delafield, both of WI (US)

(73) Assignee: Husco International, Inc., Waukesha, WI (US)

( * ) Notice: Subject to any disclaimer, the term of this patent is extended or adjusted under 35 U.S.C. 154(b) by 0 days.

(21) Appl. No.: 09/464,234

(22) Filed: Dec. 15, 1999

(51) Int. Cl.[7] ..... E02F 3/76

(52) U.S. Cl. ..... 172/7; 172/781; 701/50

(58) Field of Search ..... 172/4.5, 2, 7, 4, 172/12, 779, 780, 781, 783, 788, 799, 799.5, 811, 816, 824, 828, 830, 834; 701/50

(56) References Cited

U.S. PATENT DOCUMENTS

| | | | | |
|---|---|---|---|---|
| 3,516,497 | | 6/1970 | Waterson | 172/4.5 |
| 4,045,893 | | 9/1977 | Feinzilber et al. | 172/4.5 X |
| 4,085,805 | | 4/1978 | Hawkins et al. | 172/4.5 |
| 4,807,131 | | 2/1989 | Clegg | 172/4.5 X |
| 5,647,439 | | 7/1997 | Burdick et al. | 172/4.5 |
| 5,764,511 | | 6/1998 | Henderson | 172/4.5 X |
| 5,819,190 | | 10/1998 | Nakagami et al. | 172/4.5 X |
| 5,905,968 | * | 5/1999 | Staub et al. | 172/4.5 X |
| 5,935,183 | * | 8/1999 | Sahm et al. | 701/50 |
| 6,028,524 | * | 2/2000 | Hartman et al. | 172/4.5 X |
| 6,082,927 | * | 7/2000 | Dahlinger et al. | 172/4.5 X |
| 6,089,327 | * | 7/2000 | Kimura et al. | 172/4.5 |
| 6,112,145 | * | 8/2000 | Zachman | 701/50 |
| 6,128,563 | * | 10/2000 | Muraro | 701/50 |
| 6,129,156 | * | 10/2000 | Boast et al. | 172/4.5 |

* cited by examiner

*Primary Examiner*—Christopher J. Novosad
(74) *Attorney, Agent, or Firm*—George E. Haas; Quarles & Brady LLP

(57) ABSTRACT

The position of the blade of a motor grader is controlled to maintain a smoothly graded surface even when the grader's front wheels travel over undulating ungraded ground. This is accomplished by sensing the degree to which the grader frame pivots with respect to the rear wheels and employing the pivot angle to derive the resultant change in blade position. That change is used to operate a mechanism that produces movement of the blade relative to the earth thereby compensating for effects of the pivoting action.

16 Claims, 2 Drawing Sheets

BLADE HEIGHT CONTROL SYSTEM FOR A MOTORIZED GRADER

BACKGROUND OF THE INVENTION

The present invention relates to earth moving equipment, such as a motorized grader, and more particularly to systems controlling the position of a blade with respect to the ground on which the equipment travels.

During road construction, the earth is graded to a relatively smooth subsurface prior to laying asphalt or concrete which forms the surface of the road. The graded subsurface is produced by a machine that has a blade which scrapes the earth to a level desired for the subsurface.

A typical motorized road grader has the blade mounted between the front and rear wheels. Therefore, the front wheels ride on an uneven, ungraded surface ahead of the blade and the rear wheels ride on the smoother graded surface produced by the blade. As the front wheels move over undulations in the ungraded surface, the relative position of the blade changes, thereby producing an undulating graded surface. Thus the grader must make multiple passes over the area being graded until the surface has the desired degree of smoothness. Alternatively, the operator has to continuously make manual adjustments to the blade height, which requires a experienced operator and can produce operator fatigue.

SUMMARY OF THE INVENTION

The present invention provides a mechanism which compensates for movement of an earth mover blade so that a relatively smooth graded surface can be produced without making multiple grading passes over the same area. In addition the present mechanism does not require an experienced grader operator and eliminates fatigue resulting from continuous manual adjustment of blade height.

A machine, that produces a graded surface of earth, has front wheels, rear wheels and a frame to which the blade and wheels are attached. An apparatus is provided on the machine to control the position of the blade to produce a smoothly graded surface regardless of undulations of the ground on which the front wheels travel. That apparatus includes a sensor which detects an amount of movement of the frame with respect to either the rear wheels or the front wheels. A controller produces a compensation signal in response to the amount of movement detected by the sensor and a mechanism responds to the compensation signal by producing movement of the blade with respect to the earth.

In one embodiment of the invention, the mechanism moves the blade with respect to the frame. This version also may have another sensor that detects the position of the blade relative to the frame and provides a blade position signal. The controller produces the compensation signal also in response to the blade position signal.

In a different embodiment, the mechanism moves the front wheels with respect to the frame. Another sensor may be provided to detect the position of the front wheels relative to the frame and provide a wheel position signal. The compensation signal also is used by the controller to operate the mechanism.

DETAILED DESCRIPTION OF THE INVENTION

Figure 1:
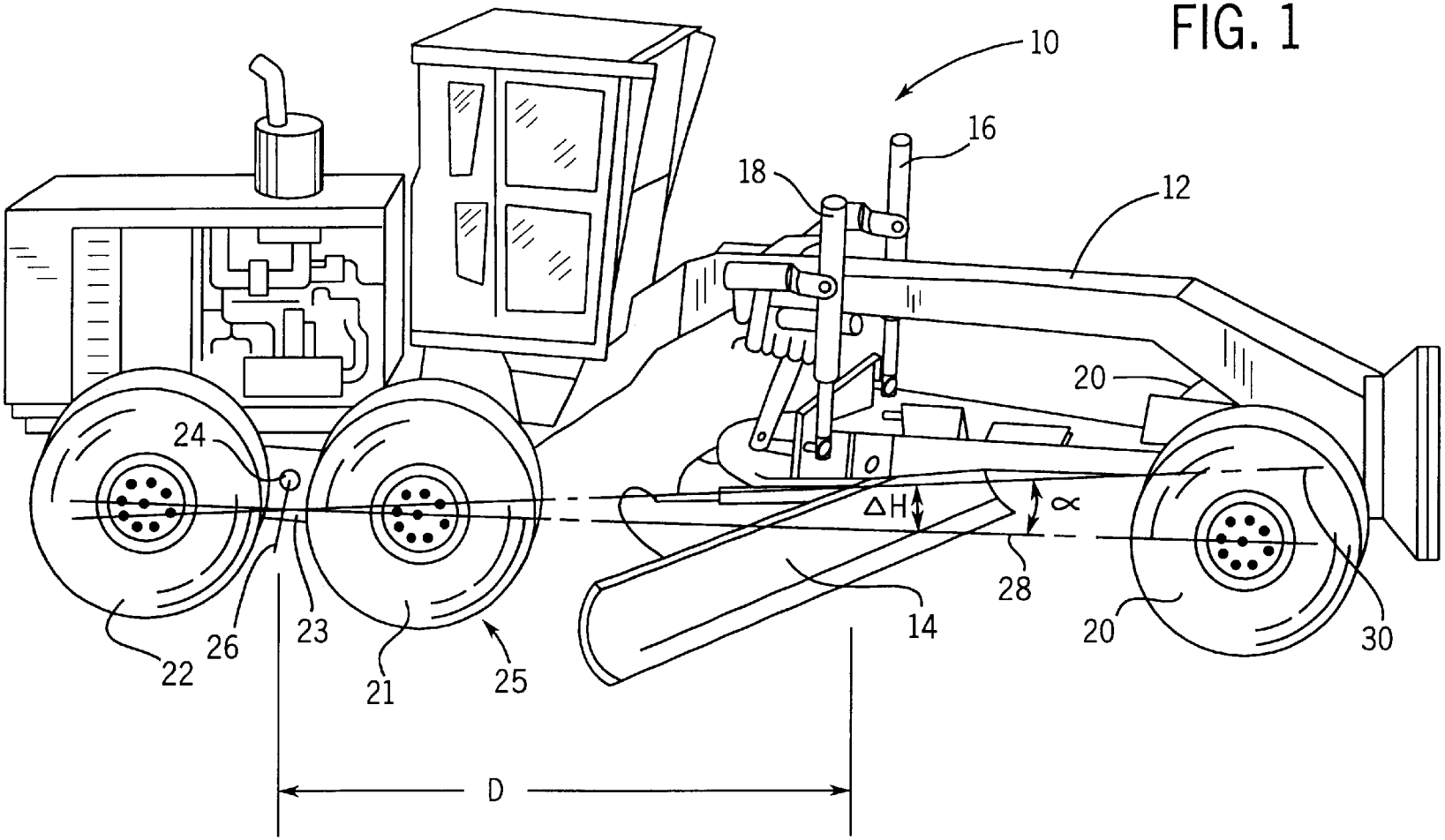
FIG. 1 is an isometric view of a road grader into which the present invention is incorporated.

FIG. 1 shows a motorized grader 10 having a frame 12 extending the length of the grader. An implement, such as a blade 14, is movably mounted on the frame 12 and can be raised and lowered by a pair of hydraulic cylinders 16 and 18 that are attached to the frame. Additional hydraulic actuators are provided to rotate the blade to different angles about a vertical axis which passes through the frame 12. Still other actuators alter the pitch of the blade as is standard practice.

The grader 10 moves along the ground on a pair of front wheels 20 and four rear wheels, two of which are on each side of the frame 12 with rear wheels 21 and 22 being visible in FIG. 1. A rear wheel assembly 25 on each side of the frame is formed by a tandem arm 23 to which the rear wheels 21 and 22 are mounted. The tandem arm 23 in turn is coupled to the frame 12 by an axle 24 and is able to pivot about axis 26.

When the grader 10 is to move earth, the blade 14 is lowered to a desired depth below the surface of the ground. At that time, the center of the front wheels 20, both rear wheels 21 and 21, and the pivot axis 26 fall are aligned as depicted by line 28. As the grader 10 moves forward, the blade 14 pushed earth aside producing a relatively smooth surface. Soon thereafter the rear wheels 21 and 22 ride on that smooth surface produced by the blade, while the front wheels 20 still ride on the higher ungraded surface. As a result, the front wheels 20 are raised up with respect to the rear wheels 21 and 22 so that line 30 now passes through the center of the front wheels 20 and pivot axis 26 of the rear tandem arm 23. The centers of the rear wheels 21 and 22 do not fall on this second line 30. Thus the frame has pivoted upward, where angle $\alpha$ between lines 28 and 30 indicates the amount of that movement.

As the front wheels 20 continue to travel over the undulating, ungraded surface ahead of the blade 14, angle $\alpha$ changes with variation of that surface. As angle $\alpha$ changes so does the relationship of the blade 14 to the earth thus producing an uneven surface behind the blade 14. To some degree the undulations of the ungraded surface are reproduced in the graded surface produced by the blade.

Figure 2:
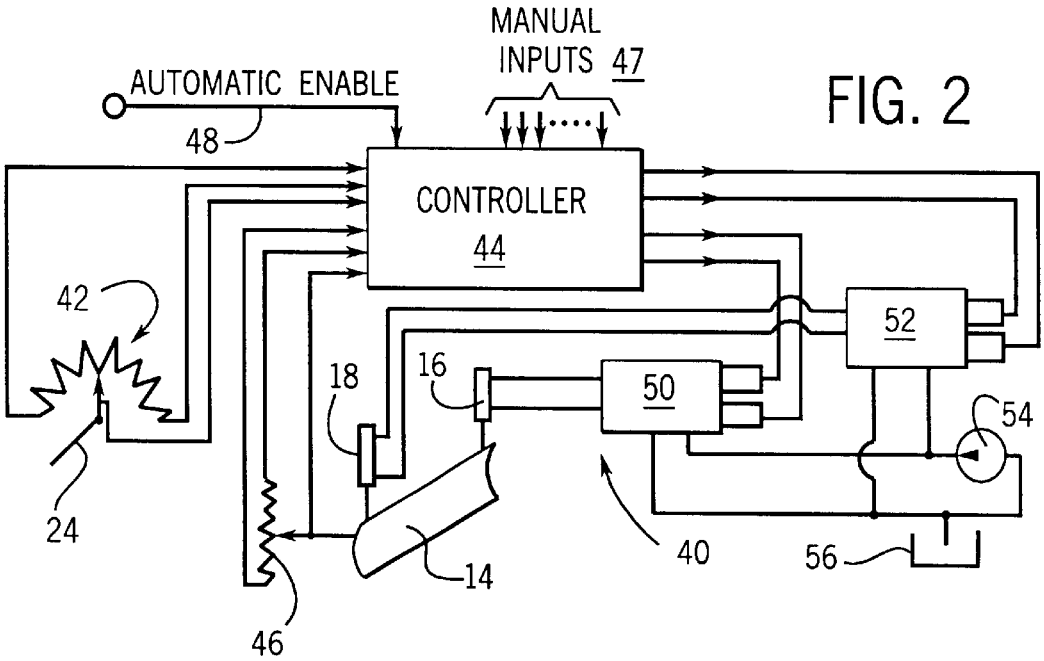
FIG. 2 is a schematic representation of the control circuit for regulating the position of the blade on the motorized grader.

With reference to FIG. 2, the motor grader 10 includes an automatic control circuit 40 that compensates for the pivoting of the frame with respect to the rear wheels and the resultant changes in blade position. That control circuit 40 has a sensor 42 connected to the rear tandem arm 23 to detect the angular motion of the frame 12 with respect to rear wheel assembly 25. The sensor 42 can be a potentiometer with its wiper mechanically connected to move as the frame and wheel assembly pivot. Thus, the resistance of the potentiometer varies as a function of the pivot angle of the rear wheel assembly 25. The sensor 42 is electrically connected to inputs of a controller 44.

The controller 44 includes a microcomputer and associated input/output circuits and a memory for storing and executing a control program to implement the present invention. A series of inputs 47 are provided from controls in the cab of the grader 10 which enable the operator to manually operate the hydraulic cylinders that position the blade 14. An automatic enable input 48 to the controller 44 activates and deactivates the automatic blade height control, as will be described.

The controller 44 also receives inputs from a blade position sensor 46, such as a linear potentiometer with its wiper connected to the blade 14 and the body of the potentiometer fixedly connected to the frame 12. Thus the resistance of the sensor 46 varies as the blade is raised and lowered by cylinders 16 and 18, thereby providing a blade position signal indicative of the relative position of the blade 14 with respect to the grader frame 12.

Outputs of the controller 44 are coupled to first and second solenoid operated hydraulic control valve assemblies 50 and 52. The two control valve assemblies can be of any of several commercially available types such as the valve assembly disclosed in U.S. patent application Ser. No. 09/069,513, the description of which is incorporated herein by reference. Each control valve assembly 50 and 52 has a pair of work ports connected to the upper and lower chambers of the respective cylinders 16 and 18 which control the height of the grader blade 14. A pair of solenoids on each of the control valve assemblies 50 and 52 are electrically operated by compensation signals from the controller 44.

Activation of one of the solenoids applies hydraulic fluid from a pump 54 to one of the cylinder chambers and drains the hydraulic fluid from the other cylinder chamber to a tank 56. Activation of the other solenoid for the control valve 50 or 52 applies hydraulic fluid from the pump 54 to the other chamber of the cylinders 16 or 18, and drains the hydraulic fluid from the other chamber. Thus, by selectively actuating one of the solenoids the cylinder 16 and 18 can raise or lower the respective blade.

It will appreciated by one skilled in the art that each of the control valve assemblies 50 and 52 is independently controlled manually by the motor grader operator to actuate only one of the two cylinders 16 or 18. This enables only one end of the blade to raise or lower, thus tilting it to provide a transversely sloping graded surface.

Once the desired height and tilt of the blade 14 has been manually set, the operator actuates a input device to produce a signal on line 48 which causes the controller 44 to execute an automatic blade position control program. In this mode of operation, the controller 44 responds to the signal from sensor 42 which indicates pivoting of the frame 12 with respect to the rear wheel assembly 25. The controller processes the electrical signal from the sensor 42 to derive the angle $\alpha$ that the grader has pivoted from the position at the time automatic control was enabled by the signal on line 48. Specifically, when automatic control is enabled, the controller 44 stores the signal level from the pivot sensor 42 as a home or reference pivot location and also stores the signal level from blade sensor 46 as the home or reference blade position. Thereafter, the controller 44 interprets changes in the signal from the pivot sensor 42 as indicating tilting of the frame 12 with respect to the rear wheels 21 and 22. In response, the controller computes the angle $\alpha$ from the sensor's electrical signal. The value of $\alpha$ is then used to derive the change in position of the blade 14 caused by the tilting. The sign of angle $\alpha$ indicates whether the blade has been raised or lowered due to the movement of the front wheels 20 over the ungraded ground.

The change in the blade height $\Delta H$ with respect to the ground is computed according to the expression $\Delta H = D \sin \alpha$. The controller 44 then utilizes the value of $\Delta H$ to determine how to operate the blade cylinders 16 and 18 to move the blade 14 in the opposite direction to compensate for the movement of the blade produced by the frame pivoting with respect to the rear wheels 21 and 22. If $\alpha$ has a positive sign, the blade 14 has moved upward and must be compensated by the hydraulic system moving the blade downward by an amount corresponding to $\Delta H$. As a consequence, the controller 44 then actuates both of the control valve assemblies 50 and 54 to introduce hydraulic fluid into the top chamber of the blade cylinders 16 and 18 to move the blade downward. The application of hydraulic fluid to the cylinder 16 and 18 continues until the signal from the blade sensor 46 indicates that the blade has moved by an amount corresponding to $\Delta H$. When this occurs, the controller 44 terminates application of hydraulic fluid to the cylinders 16 and 18. It should be noted that cylinders 16 and 18 are actuated equally so that both ends of the blade 14 move vertically the same amounts. This equal movement of both ends of the blade 14 maintains any blade tilt set manually by the operator.

Correspondingly, if the sign of $\alpha$ indicates that the blade 14 has moved downward due to frame 12 tilting with respect to the rear wheels 21 and 22, the controller 44 activates the solenoid valve assemblies 50 and 52 to apply hydraulic fluid from pump 54 to the lower chambers of the blade cylinders 16 and 18. This action causes the blade 14 to move upward which compensates for the downward movement due to the frame pivoting with respect to the rear wheels. Herein again, the controller monitors the signal from the blade height sensor 46 to determine when the blade has moved the proper amount $\Delta H$. At that time, the controller 44 deactivates each of the valve solenoids to terminate further application of hydraulic fluid to cylinders 16 and 18 thereby maintaining the blade in the new position for proper grading.

In this fashion, the blade 14 is moved up and down to compensate to the corresponding opposite movement due to the pivoting of the motor grader frame 12 as the front wheels 20 move over the ungraded ground. The use of the blade sensor 46 provides a feed back mechanism to ensure that the blade has moved to the desired position.

Figure 3:
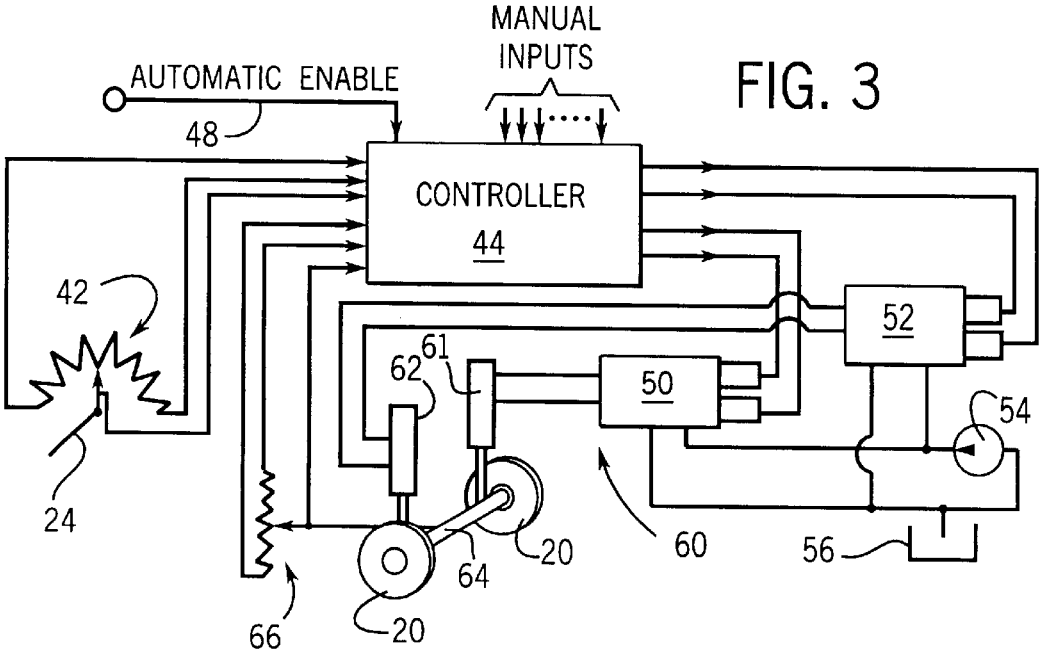
FIG. 3 is schematically represents an alternative system for controlling the position of the motor grader blade.

With reference to FIG. 3, an alternative system for compensating for blade position changes as the grader moves forward. This embodiment has a control system 60 with similar components to those shown in FIG. 2 which have been assigned identical reference numerals. However, the control valve assemblies 50 and 52 are not connected to the blade cylinders 16 and 18, but instead operate a pair of cylinders 61 and 62 which are connected between the frame 12 and the axle 64 for the front wheels 20. As an alternative a signal valve assembly could be employed to operate both wheel cylinders 61 and 62. The axle 64 also is connected to a sensor 66 which detects the relative position of the front wheels 20 with respect to the frame 12. The sensor 66 may be a linear potentiometer having a wiper connected to the axle 64 and providing a wheel position signal to the controller 44.

Operation of the control circuit 60 is similar to that described previously with respect to the system in FIG. 2, except that the distance D now represents the distance between the rear axle 24 and the front wheel axle 64. Thus $\Delta H$ now represents the height that the rear wheels have moved with respect to the rear axle. Therefore, the height change $\Delta H$ corresponds to the amount of movement to be produced by the front wheel cylinders 61 and 62. As a consequence, the controller actuates the valve assemblies 50 and 52 to produce the counter acting or compensating change $-\Delta H$ in the distance between the frame 12 and the front wheel axle 64.

The cylinder 61 and 62 move the front axle 64 vertically with respect to the frame 12 until the signal from the axle sensor 66 indicates that the proper amount of movement has occurred. At that time the controller 44 terminates further application of hydraulic fluid to the wheel cylinders 61 and 62 by deactivating the valve assemblies 50 and 52. It should be noted that the wheels cylinders 61 and 62 are actuated equally so that both the left and right sides axle 64 move the corresponding compensation distance. Alternatively, wheel cylinders 61 and 62 can be replaced by a single cylinder used to raise and lower a pivot point for the front axle of the motorized grader.

Although either of the two systems described herein can be used alone, increased versatility can be provided by using both systems on the same motorized grader.

What is claimed is:

1. An apparatus for controlling position of a blade of a machine that produces a graded surface of earth, wherein the machine has a frame on which the blade is mounted, and front wheels and rear wheels mounted to the frame, said apparatus comprising:

first sensor which detects an amount of movement of the frame with respect to one of the rear wheels and the front wheels that results from the respective wheels traveling over the earth, and the first sensor produces an electrical signal indicating that amount of movement;

an electronic controller connected to the first sensor and producing an electrical compensation signal in response to the amount of movement indicated by the electrical signal; and a mechanism which responds to the electrical compensation signal to control how deeply the blade enters the earth.

2. The apparatus as recited in claim 1 wherein the electronic controller derives a change in position of the blade from the amount of movement.

3. The apparatus as recited in claim 1 wherein the mechanism moves the blade with respect to the frame.

4. The apparatus as recited in claim 3 wherein the mechanism comprises a fluid cylinder that couples the blade to the frame.

5. The apparatus as recited in claim 4 wherein the mechanism further comprises a valve assembly which controls flow of fluid to the fluid cylinder in response to the electrical compensation signal from the electronic controller.

6. The apparatus as recited in claim 3 further comprising a second sensor that detects a position of the blade relative to the frame and produces an electrical output signal that provides a blade position indication to the electronic controller.

7. The apparatus as recited in claim 6 wherein the electronic controller also is connected to the second sensor and produces the electrical compensation signal further in response to the blade position indication.

8. The apparatus as recited in claim 1 wherein the mechanism moves one of the rear wheels and the front wheels with respect to the frame to move the blade with respect to the earth.

9. The apparatus recited in claim 8 further comprising a second sensor that detects a position of the one of the rear wheels and the front wheels relative to the frame, and produces an electrical output signal that provides a wheel position indication to the electronic controller; and the electronic controller produces the electrical compensation signal further in response to the wheel position indication.

10. The apparatus as recited in claim 1 wherein the mechanism moves the front wheels with respect to the frame.

11. An apparatus for controlling position of a blade of a earth moving machine, having a frame to which the blade is mounted, front wheels connected to the frame, and rear wheels mounted on an arm that pivots vertically with respect to the frame, said apparatus comprising:

a first sensor detecting an amount that the arm pivots with respect to the frame and producing an electrical signal indicating a vertical pivot angle;

an electronic controller connected to the first sensor and deriving a change in blade position from the vertical pivot angle indicated by the electrical signal, and producing an electrical compensation signal in response to the change in blade position; and a mechanism which moves the blade in response to the electrical compensation signal to control how deeply the blade enters the earth.

12. The apparatus as recited in claim 11 wherein the mechanism moves the blade with respect to the frame.

13. The apparatus as recited in claim 12 wherein the mechanism comprises a fluid cylinder that couples the blade to the frame, and valve assembly which controls flow of fluid to the fluid cylinder in response to the electrical compensation signal from the electronic controller.

14. The apparatus as recited in claim 11 further comprising a second sensor that detects a position of the blade relative to the frame and produces an electrical output signal that provides a blade position indication to the electronic controller; and the electronic controller produces the electrical compensation signal further in response to the blade position indication.

15. An apparatus for controlling position of a blade of a earth moving machine, having a frame to which the blade is mounted, front wheels coupled to the frame, and rear wheels mounted on an arm that pivots vertically with respect to the frame, said apparatus comprising:

a first sensor detecting an amount that the arm pivots with respect to the frame and producing an electrical signal that provides a pivot angle indication;

a electronic controller connected to the first sensor and deriving a change in blade position from the pivot angle indication, and the electronic controller producing an electrical compensation signal in response to the change in blade position; and a mechanism which responds to the electrical compensation signal by moving the front wheel with respect to the frame to control how deeply the blade enters the earth.

16. The apparatus as recited in claim 15 further comprising a second sensor that detects a position of the front wheels relative to the frame, and produces an electrical output signal that provides a wheel position indication to the electronic controller; and the electronic controller further responds to the wheel position indication by producing the electrical compensation signal.

* * * * *